US005732945A

United States Patent [19]

Sofia

[11] Patent Number: 5,732,945

[45] Date of Patent: Mar. 31, 1998

[54] TOY MAZE

[76] Inventor: Joseph M. Sofia, 7523 W. Winona, Harwood Heights, Ill. 60656

[21] Appl. No.: 683,497

[22] Filed: Jul. 18, 1996

[51] Int. Cl.[6] ..... A63F 7/04

[52] U.S. Cl. ..... 273/111; 273/153 R; 273/113

[58] Field of Search ..... 273/441, 111, 273/113–117, 153 R

[56] References Cited

U.S. PATENT DOCUMENTS

| | | | |
|---|---|---|---|
| 556,152 | 3/1896 | Lawrence | 273/111 |
| 589,507 | 9/1897 | Mead | 273/111 |
| 3,423,872 | 1/1969 | Dodson | 273/111 X |
| 3,785,651 | 1/1974 | Smith | 273/153 R X |
| 4,545,577 | 10/1985 | Randleman | 273/113 |
| 4,824,098 | 4/1989 | Huang | 273/153 R |

FOREIGN PATENT DOCUMENTS

| | | | |
|---|---|---|---|
| 2567411 | 1/1986 | France | 273/153 R |
| 4021531 | 4/1992 | Germany | 273/153 R |

*Primary Examiner*—Paul E. Shapiro

*Attorney, Agent, or Firm*—Michael R. McKenna

[57] ABSTRACT

A toy maze comprising a container with a ball having a plurality of passage levels with vertically extending wall segments forming passageways. Each level is separated by a tray having a plurality of apertures, some of which are trap-holes with a mechanism for limiting the movement of the ball to only one direction.

In a preferred embodiment of the toy maze of the present invention, the mechanism for limiting the movement of the ball to only one direction comprises at least one flexible flap which flexes to permit the ball to pass through an aperture from one level to the next level and resiliently blocks reverse movement of the ball.

19 Claims, 3 Drawing Sheets

TOY MAZE

BACKGROUND OF THE INVENTION

This invention relates to a toy maze having a novel trap-hole which allows a ball to move without restriction in one direction while being restricted from movement in the opposite direction.

Improvements in the art of multi-level mazes generally relate to novel structures to create more torturous paths through which the user must manipulate the maze in order to urge the ball to move therethrough. The toy maze of the present invention provides a means for limiting the movement of the ball to only one direction in operative association with one of the apertures. As with other mazes, the user can manipulate the container about its three axes, causing the ball to move from the start position to the finish position. The means for limiting the movement of the ball however will only permit the ball to move in one direction through the aperture to which it is associated. A more rigorous, challenging game results from the use of trap-holes which penalize the player by not allowing correction of ball movement through an incorrect trap-hole or non-trap-hole aperture.

Prior maze devices include U.S. Pat. No. 5,314,367 issued to Schaefer in May 24, 1994 which teaches a gate which assumes at least two different positions and each of said at least two positions directs the ball along a path. In the instant invention the trap door is maintained in one position that flexes to allow access in only one direction while remaining immoveable to block access to a ball directed to move in an opposite direction.

Other passage augmenting means are disclosed in U.S. Pat. Nos. 4,754,972 and 5,123,650 issued to Skobic and Slauter in 1988 and 1992, respectively. Both reveal multi-level rotating mazes which affect passage of the ball. See also U.S. Pat. No. 4,822,047 issued to Treer in 1989 for a combination of a game apparatus and educational device having movement elements.

Another multi-level crossing maze toy is disclosed in U.S. Pat. No. 4,861,636 issued to Watanabe in 1989. The Watanabe maze toy employs a plurality of combinable cubes. Each of the combinable cubes having one of a plurality of passages extending from the faces thereof. Once the toy maze is assembled, a specific configuration is created which does not restrict ball movement to any one direction.

Reference can also be made to U.S. Pat. No. 4,756,530 issued to Karman in 1988 for a rotating spherical shell game or toy; U.S. Pat. No. 3,700,241 issued to Tracy in 1972 for an apparatus for passing a ball through a series of concentric containers; U.S. Pat. No. 2,467,781 issued to Ribbe for a separation toy; U.S. Pat. No. 2,001,266 issued to Boynton for a maze puzzle in 1935; and a game of skill disclosed in U.S. Pat. No. 5,265,873 issued to Szilagyi in 1993.

Additionally, U.S. Pat. No. 4,494,753 issued to Wampler in 1980 reveals a three dimensional toy maze container having a plurality of interconnected vertical and horizontal tubes having a rectangular cross-section. These tubes have a plurality of adjoining apertures whereby a ball within the container may traverse a path from one tube to another. Unlike the instant invention which allows the user to see the movement of the ball through the use of a translucent container, the Wampler device maintains the ball secreted within the tubes.

U.S. Pat. No. 3,787,054 issued to Stafford in 1974 reveals a hidden maze puzzle contained ball. It teaches an arrangement whereby the ball moves only through a single non-continuous tortuous passage with said inner walls not forming any dead end passages other than said single non-continuous tortuous passage. The foregoing, while not necessarily teaching aspects of maze design, relate generally to the movement of a ball within a game comprising a ball moveable in various passageways. None however teach a means for limiting the movement of the ball to only one direction as is taught by this important invention. The means for limiting movement of the ball to only one direction is neither taught or suggested by the foregoing art.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach a variety of maze structures, not until the instant invention has a trap-hole, i.e. a one way aperture, been created for restricting the reverse movement of the ball. The trap hole of the present invention is specifically designed to allow a spherical object such as a steel ball to pass through specific apertures from one side and not the other.

The toy maze comprises a container with a ball having a plurality of passage levels with vertically extending wall segments forming passageways. Each level is separated by a tray having a plurality of apertures, some of which are trap-holes with a means for limiting the movement of the ball to only one direction.

In a preferred embodiment of the toy maze of the present invention, the means for limiting the movement of the ball to only one direction comprises at least one flexible flap which flexes to permit the ball to pass through an aperture from one level to the next level and resiliently blocks reverse movement of the ball.

It is an object of the present invention to provide a new and improved maze puzzle. It is a further object of the present invention to provide a puzzle having a trap-hole which limits movement of the ball between levels of a maze to one direction from an upper level of the maze to a lower level of the maze but not the reverse. The object of the invention is to provide a more complicated competitive toy maze to teach users the cooperative effects of gravity and spatial position in conjunction with a three dimensional axes system and to teach users means for improving hand-eye coordination.

Thus, this invention provides for the first time a trap-hole concept that will prevent a player from retracing his or her steps once the ball passes through a trap-hole. This new concept prevents the player from gaining access to a correct maze path from an incorrect maze path and at the same time preventing the player from starting at the finish position and moving backwards in an effort to solve the puzzle.

The means for limiting ball movement of the ball comprises trap-holes that may be situated in specific strategic locations along the maze path in operative association with specific apertures disposed in the horizontal trays of the device. These trap-holes contain a means for limiting the movement of the ball to only one direction and can be made from a transparent plastic whereby they will not be visible to the user, adding further complexity and puzzlement to this maze toy.

In brief, this toy maze invention provides further enhancing features which are particularly significant when the container and internal dividers are constructed of translucent materials so that the ball will be visible to the user, with the trap-holes being made of transparent materials which will tend to further confuse and complicate play, challenging the will and memory of the user to new heights.

Still other advantages will be apparent from the disclosure that follows.

SUMMARY OF THE INVENTION

This invention relates to a toy maze comprising a container with a ball having a predetermined radius and at least one generally horizontal tray disposed in the container. Each of the at least one tray has a bottom surface and a top surface with a first passage level disposed above the top surface and a second passage level disposed below the bottom surface. Each tray has a plurality of apertures. Each of the apertures has a minimum transverse dimension that is greater by a predetermined amount than the predetermined radius of the ball. Each of the passage levels on which the ball moves has a plurality of vertically extending wall segments forming at least one level passageway. The apertures and at least one level passageway comprise at least one maze path between a start position and a finish position, with the ball traverse in the container. A means for limiting the movement of the ball to only one direction is provided in operative association with at least one of the apertures.

In a preferred embodiment of the toy maze of the present invention, the means for limiting the movement of the ball to only one direction comprises at least one flexibly resilient flap. Each of said at least one flexibly resilient flap disposed adjacent to the bottom surface of one of the at least one tray in operative association with one of the apertures. Each of said at least one flap having a proximate end adjacent to said bottom surface and a free end movable between a first position adjacent to said bottom surface and a second position at a sufficient distance from said bottom surface to permit the ball to pass through said aperture from the first passage level to the second passage level. The free end of each of said at least one flap having at least one transverse dimension which is greater than the smallest dimension of said aperture so that the flap can restrict a reverse movement of the ball through said aperture.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
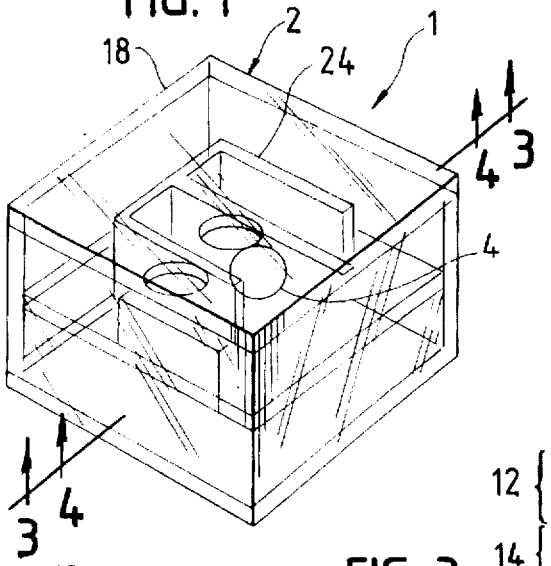
FIG. 1 is a perspective view of a first preferred embodiment of the toy maze of the present invention showing one tray with a plurality of upwardly extending wall segments disposed thereon.

The preferred embodiments depicted in the drawing include a toy maze 1 utilizing a trap-hole. The toy maze 1 has been illustrated with two and five level passageways. Without departing from the generality of the invention disclosed herein, the toy maze levels may be further replicated to accommodate a different number of level passageways.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention.

It is important, therefore, that the claims be regarded as including such equivalent constructions insofar as they do not depart from the spirit and scope of the present invention. For example, the drawing illustrates a box-like container 2 having a top wall 22, a bottom wall 16 and side walls 18. One skilled in the art will readily appreciate that the container may be cylindrical or have an irregular shape, as well. The discussion that follows, without limiting the scope of the invention, will refer to the invention as depicted in the drawing.

Referring particularly to FIGS. 1–4, the preferred embodiments of the apparatus depicted in the drawing comprise a toy maze 1 comprising a container 2; a ball 4 with a predetermined radius; at least one generally horizontal tray 6 disposed in the container 2; and means for limiting the movement of the ball to only one direction in operative association with at least one of the apertures 20.

Each of the at least one tray 6 having a bottom surface 8 and a top surface 10 with a first passage level 12 disposed above the top surface 10 and a second passage level 14 disposed below the bottom surface 8. Each of the at least one tray 6 further having a plurality of apertures 20, each of the apertures 20 having a minimum transverse dimension that is greater by a predetermined amount than the predetermined radius of the ball 4. Each of the passage levels having a plurality of vertically extending wall segments 24 forming at least one level passageway. A plethora of maze paths for the ball 4 may be provided in the maze, not being limited by the illustrated drawing accompanying this disclosure.

The apertures 20 and the at least one level passageway comprise at least one maze path between a start position and a finish position for the ball 4 to traverse in the container 2. A user can manipulate the container 2 about its three axes causing the ball 4 to move from the start position to the finish position.

In the drawing, as shown in FIG. 1, the container 2 has a box-like shape. One skilled in the art will readily appreciate that the container 2 may be cylindrical as well.

Figure 4:
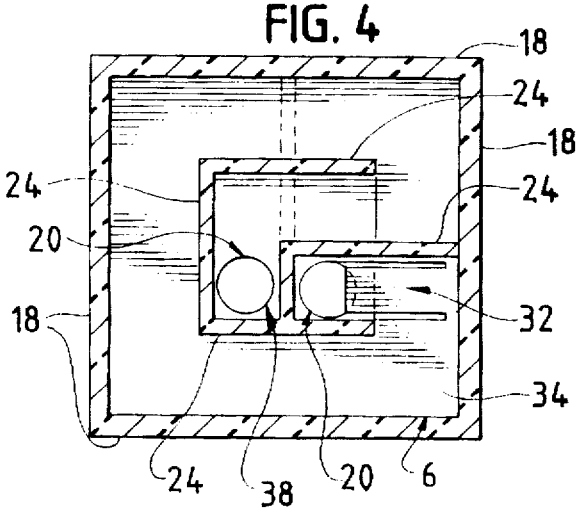
FIG. 4 is a cross-sectional view taken along the line of 4—4 of FIG. 1 showing a transparent sheet having a hole and a flexibly resilient flap respectively aligned with the apertures of the tray.
Figure 10:
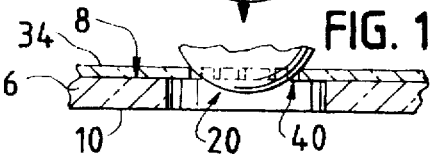
FIG. 10 is a fragmentary side elevation view showing the second preferred embodiment of the present invention of FIG. 9 with the toy maze disposed upside down showing a ball limited from moving through the breach and aperture.
Figure 11:
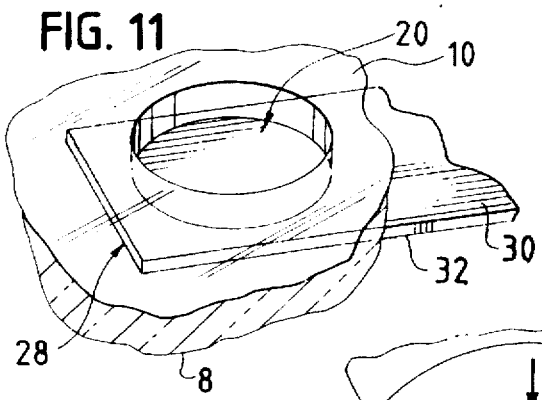
FIG. 11 is a fragmentary perspective view of a third preferred embodiment of the means for limiting the movement of the ball of the present invention showing a flap which extends beyond the perimeter of the aperture in all direction.
Figure 12:
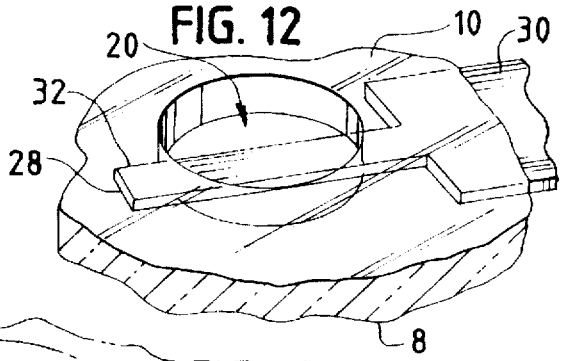
FIG. 12 is a fragmentary perspective view of a fourth preferred embodiment of the means for limiting movement of the ball of the present invention showing a flap extending in one direction beyond the perimeter of the aperture.

In a first preferred embodiment of the toy maze of the present invention, the means for limiting the movement of the ball comprises at least one flexibly resilient flap 32. As best shown in FIG. 4, each of the at least one flexibly resilient flap 32 is disposed adjacent to the bottom surface 8 of one of the at least one tray 6 in operative association with one of the apertures 20. Each of the at least one flap 32 having a proximate end 30 adjacent to the bottom surface 8 and a free end 28 that is movable between a first position adjacent to the bottom surface 8 and a second position at a sufficient distance from the bottom surface 8 to permit the ball 4 to pass through the aperture from the first passage level 12 to the second passage level 14. The free end 28 of each of the at least one flap 32 has at least one transverse dimension which is greater than the smallest dimension of the aperture so that the flap 32 can restrict a reverse movement of the ball 4 through the aperture. See particularly FIGS. 10 and 11. As more of the aperture is covered by the flap, the ball is less impeded in its horizontal movement.

Figure 2:
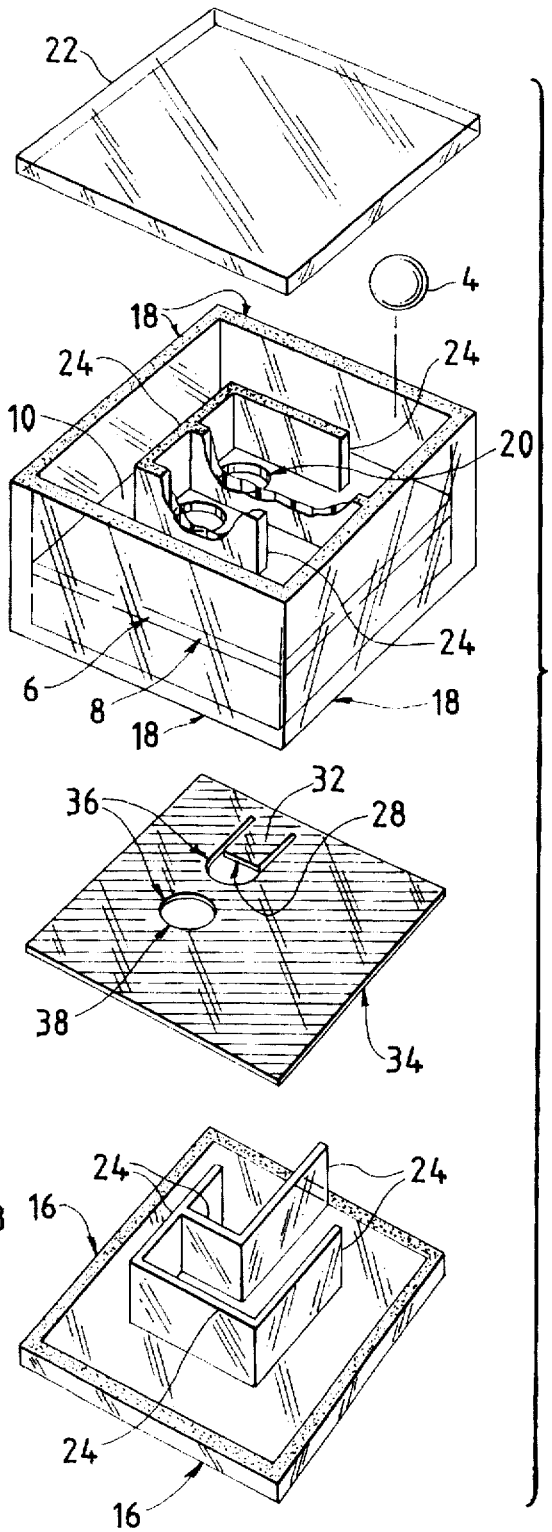
FIG. 2 is an exploded perspective view of the first preferred embodiment of the toy maze of the present invention of FIG. 1 showing a top wall, a tray having upwardly extending wall segments and apertures disposed within the side walls of the container, a flexibly resilient sheet having orifices comprising a hole and flexibly resistant flap, and a bottom wall with a plurality of wall segments disposed upwardly extending thereon.
Figure 3:
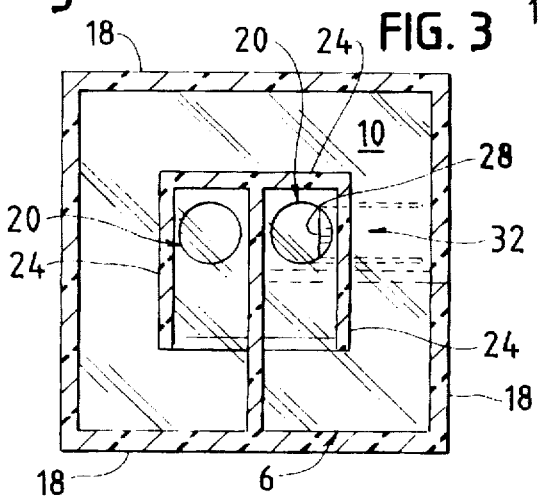
FIG. 3 is a cross-sectional view taken along the line of 3—3 of FIG. 1 of the present invention showing a flexibly resilient flap disposed in operative association with one of the apertures.

In a second preferred embodiment of the toy maze of the present invention, the means for limiting the movement of the ball comprises at least one flexibly resilient sheet 34 as shown in FIG. 2. Each of the at least one flexibly resilient sheet 34 is disposed adjacent to the impbottom surface 8 of one of the at least one tray 6 and each of the at least one flexibly resilient sheet 34 has a plurality of orifices 36 corresponding in number and pattern of distribution to the plurality of apertures 20 disposed in the at least one tray 6 to which the at least one flexibly resilient sheet 34 is adjacent. Each of the orifices 36 comprises one of (a) a hole 38 suitably sized to allow the ball 4 to pass therethrough and (b) a flap 32 having a proximate end 30 extending from the at least one flexibly resilient sheet 34 and a free end 28 movable between a first position adjacent to the bottom surface 8 and a second position at a sufficient distance from the bottom surface 8 to permit the ball 4 to pass through the aperture from the first passage level 12 to the second passage level 14. The free end 28 of each of the at least one flap 32 having at least one transverse dimension which is greater than the smallest dimension of the aperture so that the flap 32 can restrict a reverse movement of the ball 4 through the aperture.

Figure 8:
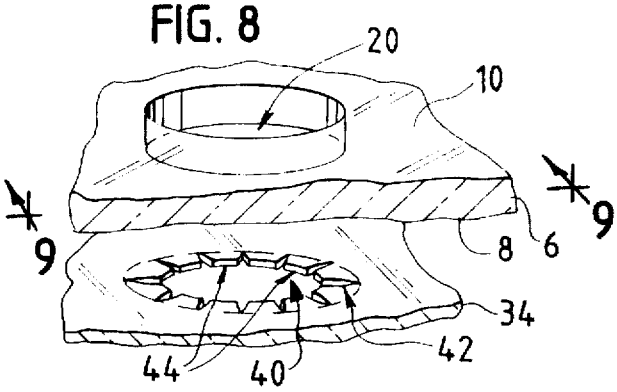
FIG. 8 is an exploded fragmentary view of a second preferred embodiment of the means for limiting the movement of the ball to only one direction showing the flexibly resilient sheet having a breach with an irregular perimeter, said perimeter having a plurality of inwardly radiating fins.
Figure 9:
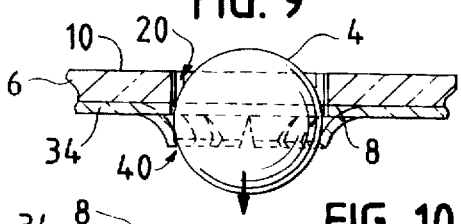
FIG. 9 is a fragmentary side elevation view taken along the line of 9—9 of FIG. 8 with the breach of the flexibly resilient sheet in operative association with the aperture of the tray and showing a ball moving in the direction of the arrow through the aperture and breach.

Reference to FIG. 8 will show a third preferred embodiment of the toy maze of the present invention, means for limiting the movement of the ball 4 comprises at least one breach 40. The breach 40 may be in a flexibly resilient sheet 34 of comparable dimension to the at least one tray 6 or a sheet segment of lesser size. Each of the at least one breach 40 is disposed adjacent to the bottom surface 8 of one of the at least one tray 6 in operative association with one of the apertures 20; each of the at least one breach 40 has an irregular perimeter 42 that is generally circular augmented by a plurality of inwardly radiating fins 44. The fins 44 may be generally skewed away from the aperture.

Figure 13:
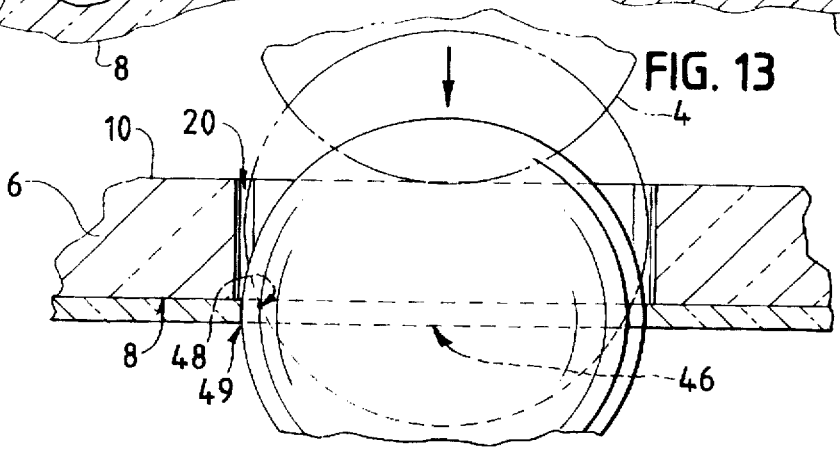
FIG. 13 is a fragmentary side elevation view of a fifth preferred embodiment of the means for limiting the movement of the ball of the present invention showing an opening disposed adjacent to the bottom surface of a tray, the opening having an expandable perimeter that expands between a static circumference which is less than the circumference of the ball and a dynamic circumference which is greater than the circumference of the ball.

In a fourth preferred embodiment of the toy maze of the present invention shown in FIG. 13, the means for limiting the movement of the ball comprises at least one opening 46. The opening 46 may be in a flexibly resilient sheet 34 of comparable dimension to the at least one tray 6 or a sheet segment of lesser size. Each of the at least one opening 46 is disposed adjacent to the bottom surface 8 of one of the at least one tray 6 in operative association with one of the apertures 20; and each of the at least one opening 46 has an expandable perimeter that is generally circular. The perimeter is expandable between a static circumference 48 that is less by a predetermined amount than the circumference of the ball 4 and a dynamic circumference 49 that is greater by a predetermined amount than the circumference of the ball 4, such that the opening 46 expands to its dynamic circumference 49 when subjected to the ball 4 moving through the aperture allowing the ball 4 to move from the first passage level 12 to the second passage level 14 of the tray 6 and the opening 46 maintains its static circumference 48 when subjected to the ball 4 moving laterally to the opening 46 along the second passage level 14.

As best shown in FIGS. 1 and 2, in a preferred embodiment of the toy maze of the present invention, the container has a box-like shape and the at least one tray 6 is rectangular in shape. Alternatively, the container may be shaped cylindrically with circular trays.

In another preferred embodiment of the toy maze of the present invention, illustrated in FIG. 1, the container 2 is translucent and a further preferred embodiment of the toy maze of the present invention has a transparent means for limiting the movement of the ball 4.

Figure 15:
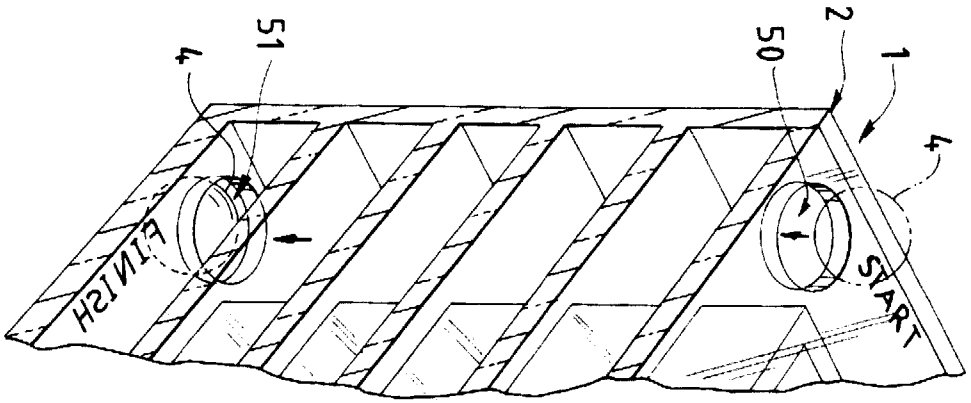
FIG. 15 is a fragmentary perspective view of another preferred embodiment of the toy maze of the present invention showing a outlet disposed in the container that is adjacent to the finished position and an inlet in the container that is adjacent to the start position.

A further refinement of the toy maze has an inlet 50 and an outlet 51 disposed in the container 2, as shown in FIG. 15. The inlet 50 and the outlet 51 each are suitably sized to allow the ball 4 to pass therethrough. The inlet 50 is disposed adjacent to the start position and the outlet 51 is disposed adjacent to the finish position. The ball 4 may be removed from the container 2 through the outlet 51 from the finish position and inserted into the container 2 through the inlet 50 to position the ball 4 at the start position from where the ball 4 may traverse within the container 2 toward the finish position.

Figure 14:
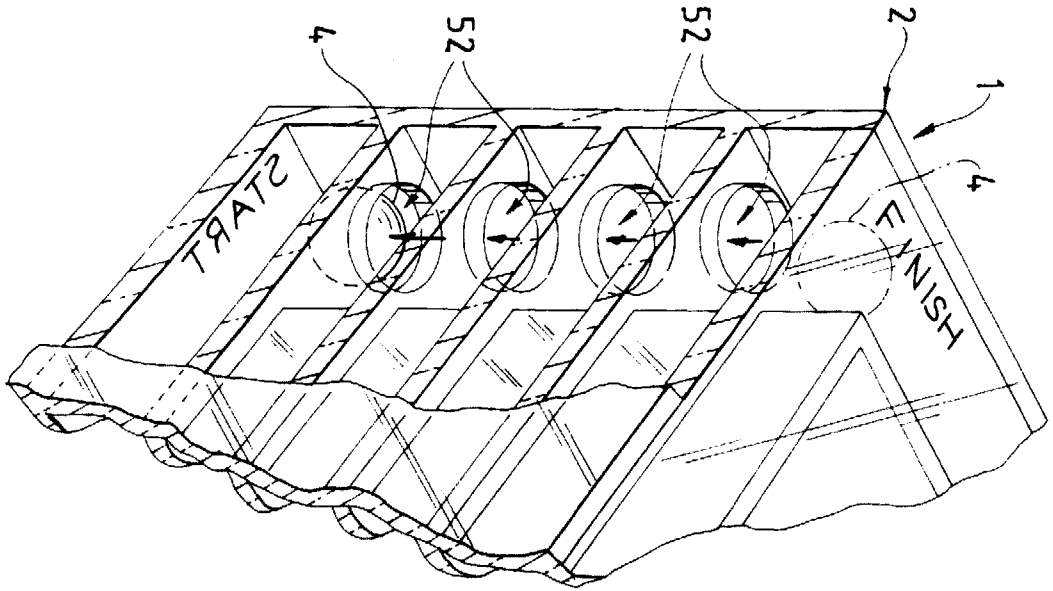
FIG. 14 is a fragmentary perspective view of a preferred embodiment of the toy maze of the instant invention disposed upside down with the level of the finish position disposed on top, showing means for replaying the ball and means for returning the ball from the finished position to a start position comprising a designated aperture in each at least one tray and wherein each of the designated apertures has a predetermined pattern of distribution.

In another preferred embodiment of the toy maze of the present invention, the container 2 is sealed. As shown in FIG. 14, the toy maze may further comprise means for replaying the ball 4 from the second passage level 14 of the at least one tray 6 to the first passage level 12 thereof.

Moreover, the toy maze with a sealed container 2 may further comprise means for returning the ball 4 from the finish position to the start position independent of the at least one maze path.

As best shown in FIG. 14, one embodiment of the means for returning the ball comprises a designated aperture 52 in each of the at least one tray 6 which allows access to the ball 4 to move from the second passage level 14 of each of the at least one tray 6 to the first passage level 12 of each of the at least one tray 6. The designated aperture 52 in each of the at least one tray 6 has a predetermined pattern of distribution.

In a preferred embodiment the designated apertures 52 of the toy maze may be placed in axial alignment.

In another preferred embodiment of the present invention, the toy maze 1 comprises a sealed translucent container 2 having a box-like shape, a ball 4 with a predetermined radius, at least one generally horizontal tray 6 disposed in the container 2, at least one flexibly resilient transparent sheet 34 for limiting the movement of the ball to only one direction in operative association with at least one of the apertures 20, and means for returning the ball 4 from the finish position to the start position independent of the at least one maze path comprising a designated aperture 52 with a predetermined pattern of distribution in each of the at least one tray 6 which allows access to the ball 4 to move from the second passage level 14 of each of the at least one tray 6 to the first passage level 12 of each of the at least one tray 6, whereby, a new game can be started.

In this embodiment of the toy maze of the present invention, each of the at least one tray 6 is rectangular in shape. Each of the at least one tray 6 has a bottom surface 8 and a top surface 10 with a first passage level 12 disposed above the top surface 10 and a second passage level 14 disposed below the bottom surface 8. Each of the at least one tray 6 further has a plurality of apertures 20 which have a minimum transverse dimension that is greater by a predetermined amount than the predetermined radius of the ball 4.

Furthermore, each of the passage levels has a plurality of vertically extending wall segments 24 forming at least one level passageway. The apertures 20 and the at least one level passageway comprise at least one maze path between a start position and a finish position for the ball 4 to traverse in the container 2. The vertically extending wall segments 24 should be positioned so as not to interfere with the movement of the trap-hole.

Additionally, each of the at least one flexibly resilient sheet 34 is disposed adjacent to the bottom surface 8 of one of the at least one tray 6; each of the at least one flexibly resilient sheet 34 has a plurality of orifices 36 corresponding in number and pattern of distribution to the plurality of apertures 20 disposed in the at least one tray 6 to which the at least one flexibly resilient sheet 34 is adjacent.

Figure 5:
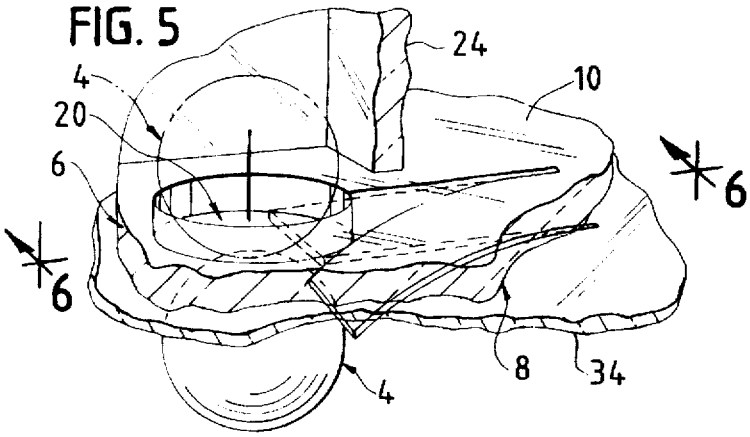
FIG. 5 is a fragmentary perspective view of a first preferred embodiment of the toy maze of the present invention arranged to show a ball moving in the direction of the arrow through an aperture in the tray and the displacement of the flexibly resilient flap to a second position at a sufficient distance to allow the ball to pass through the aperture.
Figure 6:
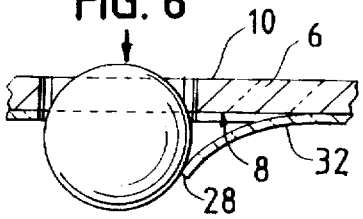
FIG. 6 is a fragmentary side elevation view taken along the line 6—6 of FIG. 5 showing the ball moving in the direction of the arrow through the aperture in the tray and the displacement of the flexibly resilient flap to a second position at a sufficient distance to allow the ball to pass through the aperture.
Figure 7:
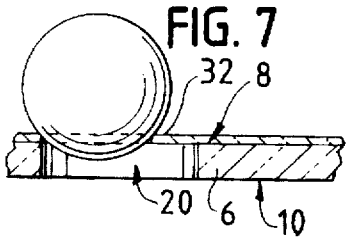
FIG. 7 is a fragmentary side elevation view of the toy maze of FIG. 6 of the present invention with the toy maze having been turned upside down to show the position of the ball having its gravitational movement blocked by the flap which is in operative association with the aperture of the tray.

Each of these orifices 36 comprise one of (a) a hole 38 suitably sized to allow the ball 4 to pass therethrough and (b) a flap 32 having a proximate end 30 extending from the at least one flexibly resilient sheet 34 and a free end 28 movable between a first position adjacent to the bottom surface 8 and a second position at a sufficient distance from the bottom surface 8 to permit the ball 4 to pass through the aperture from the first passage level 12 to the second passage level 14, as shown in FIGS. 5–7. The free end 28 of each of the at least one flap 32 has at least one transverse dimension which is greater than the smallest dimension of the aperture so that the flap 32 can restrict reverse movement of the ball 4 through the aperture, whereby, a user can manipulate the container 2 about its three axes causing the ball 4 to move from the start position to the finish position.

In another preferred embodiment of the present invention, a toy maze 1 comprises a translucent container 2 having a box-like shape; a ball 4 with a predetermined radius; at least one generally horizontal tray 6 disposed in said container 2; at least one flexibly resilient transparent sheet 34 for limiting the movement of the ball 4 to only one direction in operative association with at least one of said apertures 20; and an inlet 50 and an outlet 51 disposed in the container 2.

Each of the at least one tray 6 being rectangular in shape and has a bottom surface 8 and a top surface 10 with a first passage level 12 disposed above the top surface 10 and a second passage level 14 disposed below the bottom surface 8. Each of said at least one tray 6 further has a plurality of apertures 20. Each of said apertures 20 has a minimum transverse dimension that is greater by a predetermined amount than the predetermined radius of the ball 4.

A best mode toy maze of the present invention has a container with a box-like shape and the at least one tray is square in shape.

Furthermore, each of the passage levels has a plurality of vertically extending wall segments 24 forming at least one level passageway. The apertures 20 and the at least one level passageway comprise at least one maze path between a start position and a finish position for the ball 4 to traverse in the container 2.

Moreover, each of the at least one flexibly resilient sheet 34 is disposed adjacent to the bottom surface 8 of one of the at least one tray 6 and each of the at least one flexibly resilient sheet 34 has a plurality of orifices 36 corresponding in number and pattern of distribution to the plurality of apertures 20 disposed in the at least one tray 6 to which the at least one flexibly resilient sheet 34 is adjacent.

Each of the orifices 36 comprise one of (a) a hole 38 suitably sized to allow the ball 4 to pass therethrough and (b)

a flap 32 having a proximate end 30 extending from the at least one flexibly resilient sheet 34 and a free end 28 movable between a first position adjacent to said bottom surface 8 and a second position at a sufficient distance from said bottom surface 8 to permit the ball 4 to pass through the aperture from the first passage level 12 to the second passage level 14. The free end 28 of each of the at least one flap 32 having at least one transverse dimension which is greater than the smallest dimension of said aperture so that the flap 32 can restrict a reverse movement of the ball 4 through said aperture. Whereby, a user can manipulate the container 2 about its three axes causing the ball 4 to move from the start position to the finish position.

In this embodiment, the inlet 50 and the outlet 51 each are suitably sized to allow the ball 4 to pass therethrough. As shown in FIG. 15, the inlet 50 is disposed adjacent to the start position and the outlet 51 is disposed adjacent to the finish position, such that the ball 4 may be removed from the container 2 through the outlet 51 from the finish position and inserted into the container 2 through the inlet 50 to position the ball 4 at the start position from where the ball 4 may traverse within the container 2 toward the finish position.

It is preferred that the container, the trays, and the vertically extending wall segments be constructed on a hard translucent plastic—preferably one that is crack resistant to avoid breakage upon dropping. A thin plastic film, preferably transparent, is favored for use of the flexibly resilient flap of the trap-hole. A stainless steel ball is preferred, but any suitable replacement metal or weighted plastic ball can be used.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

The invention resides not in any one of these features per se, but rather in the particular combination of all of them herein disclosed and claimed and it is distinguished from the prior art in this particular combination of all of its structures for the function specified.

Further, the purpose of the foregoing abstract is to enable the U.S. patent and Trademark Office and the public generally, and especially the scientist, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. A toy maze comprising:

a. a container;

b. a ball with a predetermined radius;

c. at least one generally horizontal tray disposed in said container, each of said at least one tray having a bottom surface and a top surface with a first passage level disposed above the top surface and a second passage level disposed below the bottom surface, each of said at least one tray further having a plurality of apertures, each of said apertures having a minimum transverse dimension that is greater by a predetermined amount than the predetermined radius of the ball, each of the passage levels having a plurality of vertically extending wall segments forming at least one level passageway, said apertures and said at least one level passageway comprising at least one maze path between a start position and a finish position for the ball to traverse in the container; and d. means for limiting the movement of the ball to only one direction in operative association with at least one of said apertures, whereby, a user can manipulate the container about its three axes causing the ball to move from the start position to the finish position.

2. The toy maze of claim 1 wherein the means for limiting the movement of the ball comprises at least one flexibly resilient flap, each of said at least one flexibly resilient flap disposed adjacent to the bottom surface of one of the at least one tray in operative association with one of the apertures, each of said at least one flap having a proximate end adjacent to said bottom surface and a free end movable between a first position adjacent to said bottom surface and a second position at a sufficient distance from said bottom surface to permit the ball to pass through said aperture from the first passage level to the second passage level, and the free end of each of said at least one flap having at least one transverse dimension which is greater than the smallest dimension of said aperture so that the flap can restrict a reverse movement of the ball through said aperture.

3. The toy maze of claim 1 wherein the means for limiting the movement of the ball comprises at least one flexibly resilient sheet, each of said at least one flexibly resilient sheet disposed adjacent to the bottom surface of one of the at least one tray, each of said at least one flexibly resilient sheet having a plurality of orifices corresponding in number and pattern of distribution to the plurality of apertures disposed in the at least one tray to which the at least one flexibly resilient sheet is adjacent, each of said orifices comprising one of (a) a hole 38 suitably sized to allow the ball to pass therethrough and (b) a flap having a proximate end extending from the at least one flexibly resilient sheet and a free end movable between a first position adjacent to said bottom surface and a second position at a sufficient distance from said bottom surface to permit the ball to pass through said aperture from the first passage level to the second passage level, the free end of each of said at least one flap having at least one transverse dimension which is greater than the smallest dimension of said aperture so that the flap can restrict a reverse movement of the ball through said aperture.

4. The toy maze of claim 1 wherein the means for limiting the movement of the ball comprises at least one breach 40, each of said at least one breach 40 disposed adjacent to the bottom surface of one of the at least one tray in operative association with one of the apertures, each of said at least one breach having an irregular perimeter that is generally circular augmented by a plurality of inwardly radiating fins.

5. The toy maze of claim 4 wherein the fins are generally skewed away from the aperture.

6. The toy maze of claim 1 wherein the means for limiting the movement of the ball comprises at least one opening, each of said at least one opening disposed adjacent to the bottom surface of one of the at least one tray in operative association with one of the apertures, each of said at least one opening having an expandable perimeter that is generally circular, said perimeter being expandable between a static circumference that is less by a predetermined amount than the circumference of the ball and a dynamic circumference that is greater by a predetermined amount than the circumference of the ball, such that the opening expands to its dynamic circumference when subjected to the ball moving through the aperture allowing the ball to move from the first passage level to the second passage level of the tray and said opening maintains its static circumference when subjected to the ball moving laterally to said opening along the second passage level.

7. The toy maze of claim 1 wherein the container has a box-like shape and the at least one tray is rectangular in shape.

8. The toy maze of claim 1 wherein the container has a box-like shape and the at least one tray is square in shape.

9. The toy maze of claim 1 wherein the container is translucent.

10. The toy maze of claim 1 wherein the means for limiting the movement of the ball is transparent.

11. The toy maze of claim 1 further comprising an inlet and an outlet disposed in the container, said inlet and said outlet each being suitably sized to allow the ball to pass therethrough, and said inlet being disposed adjacent to the start position and said outlet being disposed adjacent to the finish position, whereby the ball may be removed from the container through the outlet from the finish position and inserted into the container through the inlet to position the ball at the start position from where the ball may traverse within the container toward the finish position.

12. The toy maze of claim 1 wherein the container is sealed.

13. The toy maze of claim 12 further comprising means for replaying the ball from the second passage level of said at least one tray to the first passage level thereof.

14. The toy maze of claim 12 further comprising means for returning the ball from the finish position to the start position independent of said at least one maze path.

15. The toy maze of claim 14 wherein the means for returning the ball comprises a designated aperture in each of said at least one tray which allows access to the ball to move from the second passage level of each of said at least one tray to the first passage level of each of said at least one tray.

16. The toy maze of claim 15 wherein the designated aperture in each of said at least one tray has a predetermined pattern of distribution.

17. The toy maze of claim 16 wherein the designated apertures are in axial alignment.

18. A toy maze comprising:

a. a sealed translucent container having a box-like shape;

b. a ball with a predetermined radius;

c. at least one generally horizontal tray disposed in said container, each of said at least one tray being rectangular in shape, each of said at least one tray having a bottom surface and a top surface with a first passage level disposed above the top surface and a second passage level disposed below the bottom surface, each of said at least one tray further having a plurality of apertures, each of said apertures having a minimum transverse dimension that is greater by a predetermined amount than the predetermined radius of the ball, each of the passage levels having a plurality of vertically extending wall segments forming at least one level passageway, said apertures and said at least one level passageway comprising at least one maze path between a start position and a finish position for the ball to traverse in the container; and d. at least one flexibly resilient transparent sheet for limiting the movement of the ball to only one direction in operative association with at least one of said apertures, each of said at least one flexibly resilient sheet disposed adjacent to the bottom surface of one of the at least one tray, each of said at least one flexibly resilient sheet having a plurality of orifices corresponding in number and pattern of distribution to the plurality of apertures disposed in the at least one tray to which the at least one flexibly resilient sheet is adjacent, each of said orifices comprising one of (a) a hole 38 suitably sized to allow the ball to pass therethrough and (b) a flap having a proximate end extending from the at least one flexibly resilient sheet and a free end movable between a first position adjacent to said bottom surface and a second position at a sufficient distance from said bottom surface to permit the ball to pass through said aperture from the first passage level to the second passage level, the free end of each of said at least one flap having at least one transverse dimension which is greater than the smallest dimension of said aperture so that the flap can restrict a reverse movement of the ball through said aperture, whereby, a user can manipulate the container about its three axes causing the ball to move from the start position to the finish position; and e. means for returning the ball from the finish position to the start position independent of said at least one maze path comprising a designated aperture with a predetermined pattern of distribution in each of said at least one tray which allows access to the ball to move from the second passage level of each of said at least one tray to the first passage level of each of said at least one tray, whereby, a new game can be started.

19. A toy maze comprising:

a. a translucent container having a box-like shape;

b. a ball with a predetermined radius;

c. at least one generally horizontal tray disposed in said container, each of said at least one tray being rectangular in shape, each of said at least one tray having a bottom surface and a top surface with a first passage level disposed above the top surface and a second passage level disposed below the bottom surface, each of said at least one tray further having a plurality of apertures, each of said apertures having a minimum transverse dimension that is greater by a predetermined amount than the predetermined radius of the ball, each of the passage levels having a plurality of vertically extending wall segments forming at least one level passageway, said apertures and said at least one level passageway comprising at least one maze path between a start position and a finish position for the ball to traverse in the container; and d. at least one flexibly resilient transparent sheet for limiting the movement of the ball to only one direction in operative association with at least one of said apertures, each of said at least one flexibly resilient sheet disposed adjacent to the bottom surface of one of the at least one tray, each of said at least one flexibly resilient sheet having a plurality of orifices corresponding in number and pattern of distribution to the plurality of apertures disposed in the at least one tray to which the at least one flexibly resilient sheet is adjacent, each of said orifices comprising one of (a) a hole suitably sized to allow the ball to pass therethrough and (b) a flap having a proximate end extending from the at least one flexibly resilient sheet and a free end movable between a first position adjacent to said bottom surface and a second position at a sufficient distance from said bottom surface to permit the ball to pass through said aperture from the first passage level to the second passage level, the free end of each of said at least one flap having at least one transverse dimension which is greater than the smallest dimension of said aperture so that the flap can restrict a reverse movement of the ball through said aperture, whereby, a user can manipulate the container about its three axes causing the ball to move from the start position to the finish position; and e. an inlet and an outlet disposed in the container, said inlet and said outlet each being suitably sized to allow the ball to pass therethrough, and said inlet being disposed adjacent to the start position and said outlet being disposed adjacent to the finish position, whereby the ball may be removed from the container through the outlet from the finish position and inserted into the container through the inlet to position the ball at the start position from where the ball may traverse within the container toward the finish position.

* * * * *